US008286964B2

(12) United States Patent
Jung

(10) Patent No.: US 8,286,964 B2
(45) Date of Patent: Oct. 16, 2012

(54) PAPER SUPPRESSING DEVICE FOR PAPER FINISHING APPARATUS

(75) Inventor: Kijo Jung, Seoul (KR)

(73) Assignee: Biztechone Co., Ltd., Seoul (KR)

( * ) Notice: Subject to any disclaimer, the term of this patent is extended or adjusted under 35 U.S.C. 154(b) by 0 days.

(21) Appl. No.: 13/188,046

(22) Filed: Jul. 21, 2011

(65) Prior Publication Data

US 2012/0032390 A1 Feb. 9, 2012

(30) Foreign Application Priority Data

Aug. 4, 2010 (KR) ..... 10-2010-0075229

(51) Int. Cl.
*B65H 31/26* (2006.01)

(52) U.S. Cl. ..... 271/220

(58) Field of Classification Search ..... 271/220
See application file for complete search history.

(56) References Cited

U.S. PATENT DOCUMENTS

| | | | | |
|---|---|---|---|---|
| 6,702,278 | B1 * | 3/2004 | Michel | 271/220 |
| 7,950,652 | B2 * | 5/2011 | Terao et al. | 271/220 |
| 2008/0315504 | A1 * | 12/2008 | Terao et al. | 271/167 |

FOREIGN PATENT DOCUMENTS

| | | | |
|---|---|---|---|
| JP | 09020452 A | * | 1/1997 |
| KR | 100578146 B1 | * | 5/2005 |
| KR | 101098944 A | * | 11/2010 |

* cited by examiner

*Primary Examiner* — Gerald McClain

(74) *Attorney, Agent, or Firm* — Birch, Stewart, Kolasch & Birch, LLP

(57) ABSTRACT

Disclosed is a paper suppressing device capable of improving paper alignment while safely discharging papers onto a stacker tray. The paper suppressing device includes a clamp holder shaft, a clamp on the clamp holder shaft, a crank arm to open the clamp fixed onto the clamp holder shaft, and a driving wheel driving the crank arm. A control mass, which includes a fixing member protruding from the clamp holder shaft perpendicularly to the clamp holder shaft, a pin provided perpendicularly to an end portion of the fixing member, and a lever protruding in adjacent to the fixing member, is fixed onto the clamp holder shaft. The crank arm has one end portion with a slit groove engaged with the pin of the control mass in such a manner that the pin is movable, and an opposite end portion eccentrically coupled with a rotational shaft of the driving wheel.

6 Claims, 10 Drawing Sheets

PAPER SUPPRESSING DEVICE FOR PAPER FINISHING APPARATUS

BACKGROUND OF THE INVENTION

1. Field of the Invention

The present invention relates to a paper suppressing device capable of improving paper alignment while safely discharging papers onto a stacker tray in a paper finishing apparatus installed in an image forming apparatus such as a printer or a copy machine.

2. Description of the Prior Art

In general, a paper, which has been subject to a predetermined process in an image forming apparatus such as a copy machine, is discharged onto a stacker tray through a paper discharge device.

The front end of the paper being discharged onto the stacker tray through the paper discharge device may be warped in the shape of an arc due to the internal temperature of the paper discharge device, a finishing work, or a step difference between the stacker tray and the paper discharge device. Thus, when the front end of the paper transferred onto the stacker tray makes contact with the paper stack surface of the stacker tray, the paper may be rolled. In this case, if a next paper is stacked on the rolled paper, the alignment of papers may be deteriorated.

In addition, a paper or a bundle of papers, which are not normally discharged onto the stacker tray, may not be safely and simply re-aligned.

SUMMARY

Accordingly, the present invention has been made to solve the above-mentioned problems occurring in the prior art, and an object of the present invention is to provide a paper suppressing device capable of improving the alignment of papers on a stacker tray.

Another object of the present invention is to provide a paper suppressing device capable of easily re-aligning a paper or a bundle of papers that are not normally discharged onto a stacker tray.

To accomplish the above objects of the present invention, there is provided a paper suppressing device for a paper finishing apparatus including a stacker tray provided at one side of a paper protective plate to move up and down, a paper discharge device provided at an opposite side of the paper protective plate to align a paper and transfer the paper onto the stacker tray and the paper suppressing device interposed between the stacker tray and the paper discharge device, wherein the paper suppressing device comprises a clamp unit that is open while the paper is being transferred onto the stacker tray, and returns to an initial position after the paper has been transferred onto the stacker tray to suppress papers stacked onto the stacker tray.

In addition, the clamp unit includes a clamp holder shaft, a clamp installed on the clamp holder shaft, a crank arm rotating the clamp holder shaft by a predetermined angle to open the clamp fixed onto the clamp holder shaft, and a driving wheel driving the crank arm.

In addition, the paper suppressing device further includes a control mass fixed onto the clamp holder shaft and including a fixing member protruding from the clamp holder shaft perpendicularly to the clamp holder shaft, a pin provided perpendicularly to an end portion of the fixing member, and a lever protruding in adjacent to the fixing member, wherein the crank arm has one end portion with a slit groove engaged with the pin of the control mass in such a manner that the pin is movable, and an opposite end portion eccentrically coupled with a rotational shaft of the driving wheel.

In addition, the clamp is elastically supported on the clamp holder shaft by interposing a first spring therebetween, and the clamp holder shaft is elastically supported by a second spring.

In addition, the clamp holder shaft is rotated in such a manner that the clamp moves toward the stacker tray when the pin of the control mass is movable in the slit groove of the crank arm, and the clamp holder shaft is rotated in such a manner that the clamp moves away from the stacker tray when the pin of the control mass inserted into the slit groove is pulled by the crank arm.

In addition, the paper suppressing device further includes a lever sensor installed at a lower portion of the control mass, wherein, if the lever is detected by the lever sensor due to rotation of the clamp holder shaft as the stacker tray, which is being lifted up along the paper protective plate, makes contact with the clamp, the lifting of the stacker tray is stopped.

In addition, the paper suppressing device further includes a paper stack height sensor installed on at least one side of the stacker tray.

In addition, the crank arm includes a pair of crank arms and the clamp includes two pairs of clamps.

As described above, the paper suppressing device according to the present invention can easily re-align a paper or a bundle of papers that are not normally discharged and stack the paper or the papers to a stacker tray by providing a clamp unit that is open while the paper is being transferred onto the stacker tray, and returns to an initial position after the paper has been transferred onto the stacker tray, while suppressing papers stacked onto the stacker tray. In particular, the clamp unit includes a clamp holder shaft, a clamp installed on the clamp holder shaft, a crank arm rotating the clamp holder shaft by a predetermined angle to open the clamp fixed on the clamp holder shaft, and a driving wheel driving the crank arm.

The lifting position of the stacker tray from the home position of the clamp after the paper has been discharged is determined by the contact between the stacker tray and the clamp, so that the variation in the detection of the paper stack height can be effectively reduced.

In addition, the alignment of the paper stacked on the stacker tray can be improved.

DETAILED DESCRIPTION OF THE EMBODIMENTS

Hereinafter, the technical configuration and operations of the present invention will be described in detail with reference to FIGS. 1 to 10.

Figure 1:
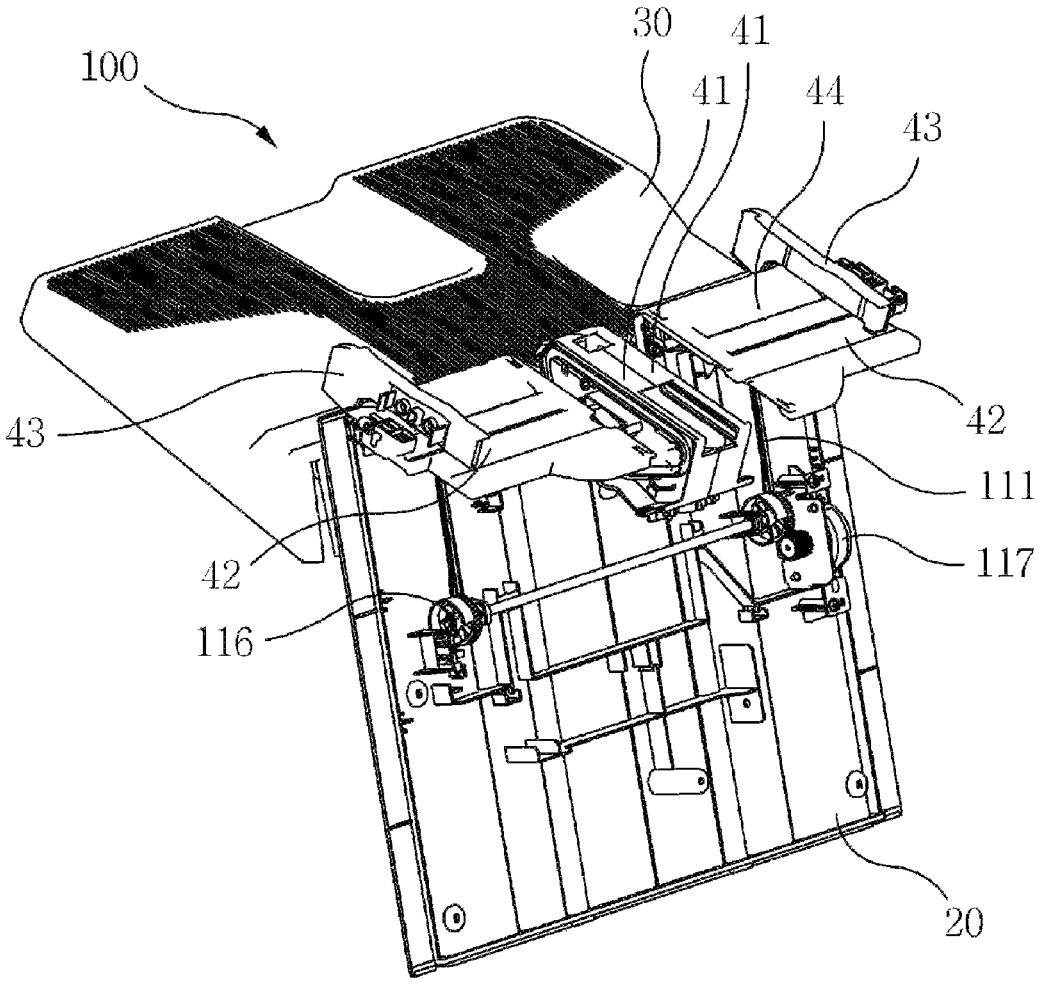
FIG. 1 is a perspective view showing a paper finishing apparatus equipped with a paper suppressing device according to the present invention.
Figure 2:
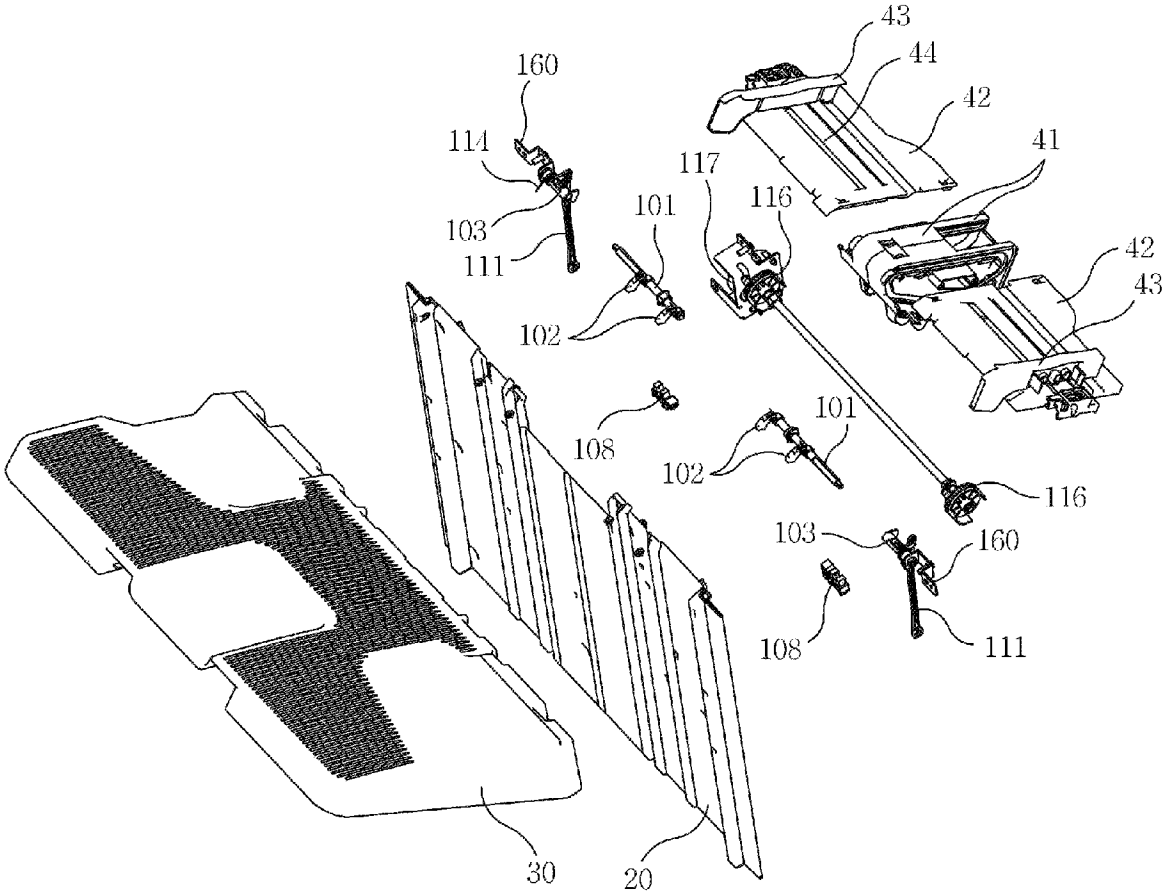
FIG. 2 is an exploded perspective view showing main components of FIG. 1.
Figure 3:
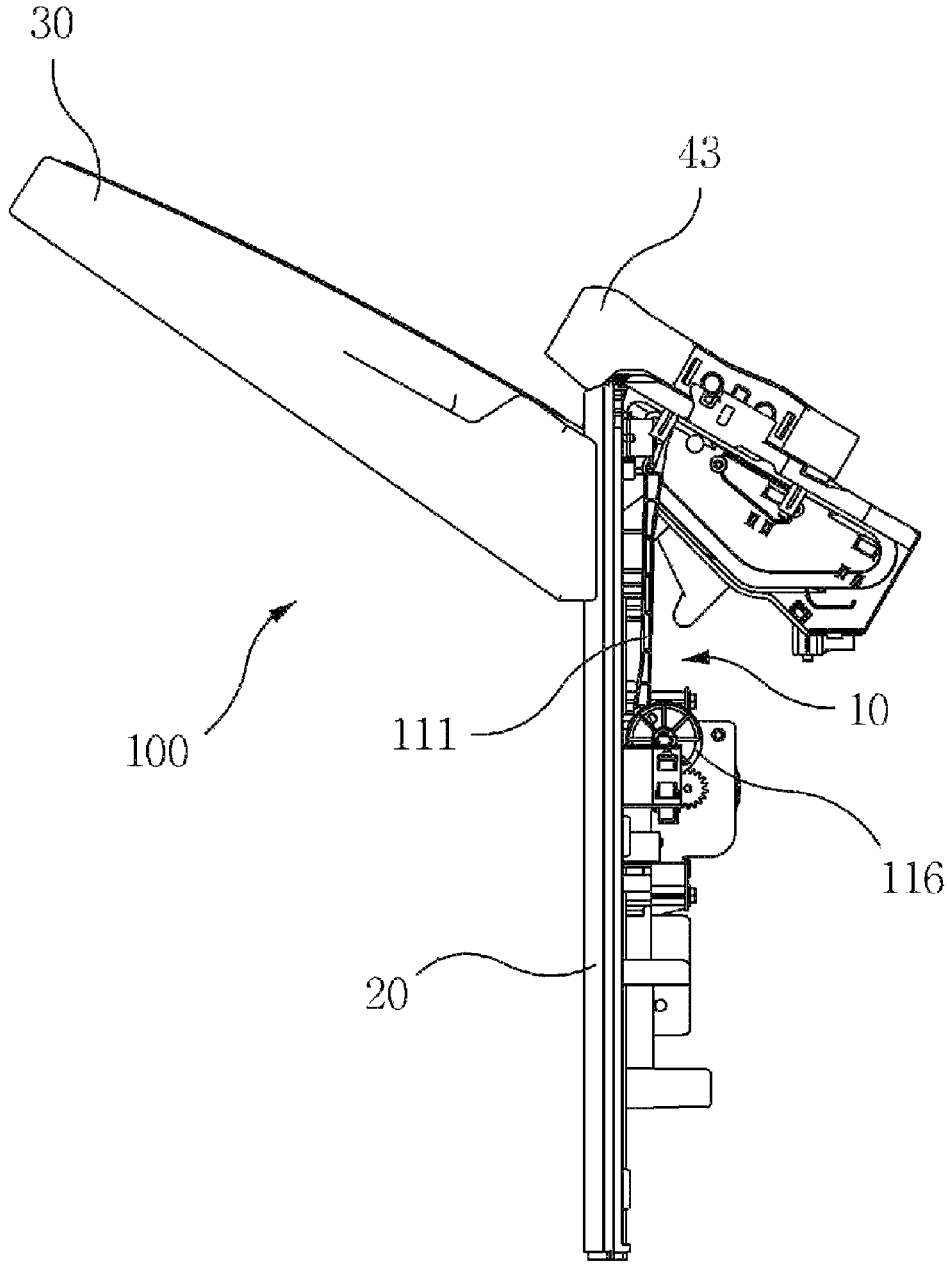
FIG. 3 is a side view of FIG. 1.

As shown in FIGS. 1 and 3, a paper fishing apparatus 100 includes a paper protective plate 20, a stacker tray 30 moving up and down along one side of the paper protective plate 20, and a paper discharge device 40 installed at the other side of the paper protective plate 20. A paper suppressing device 10 is interposed between the stacker tray 30 and the paper discharge device 40.

The paper discharge device 40 transfers a paper, which has been discharged, along discharged paper guide frames 41 and jogger guide frames 42, so that the paper can be stacked on the stacker tray 30. A paper transfer device, which is not shown, is installed at a lower portion of the discharge paper guide frame 41. Joggers 43 may be configured to move along grooves 44 formed in the jogger guide frames 42 to align papers leftward or rightward along the width of the papers.

Meanwhile, the paper suppressing device 10 according to the present invention is maintained in an open state while the papers are being transferred. After the papers have been transferred, a clamp moves toward a home position, that is, toward the stacker tray. In this state, the paper suppressing device 10 lifts the stacker tray up to suppress the papers on the stacker tray 30.

Figure 6:
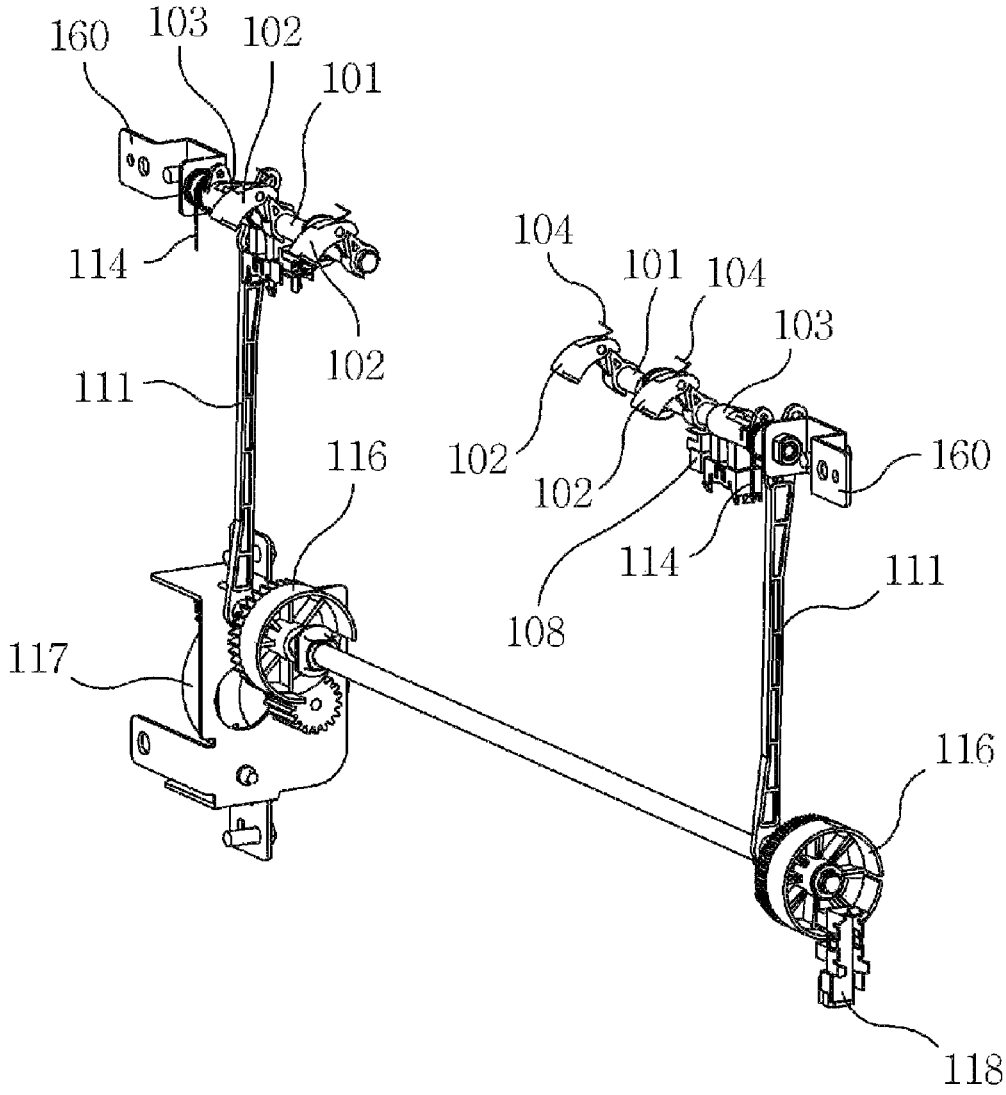
FIG. 6 is a perspective view showing one side of the paper suppressing device according to the present invention.
Figure 7:
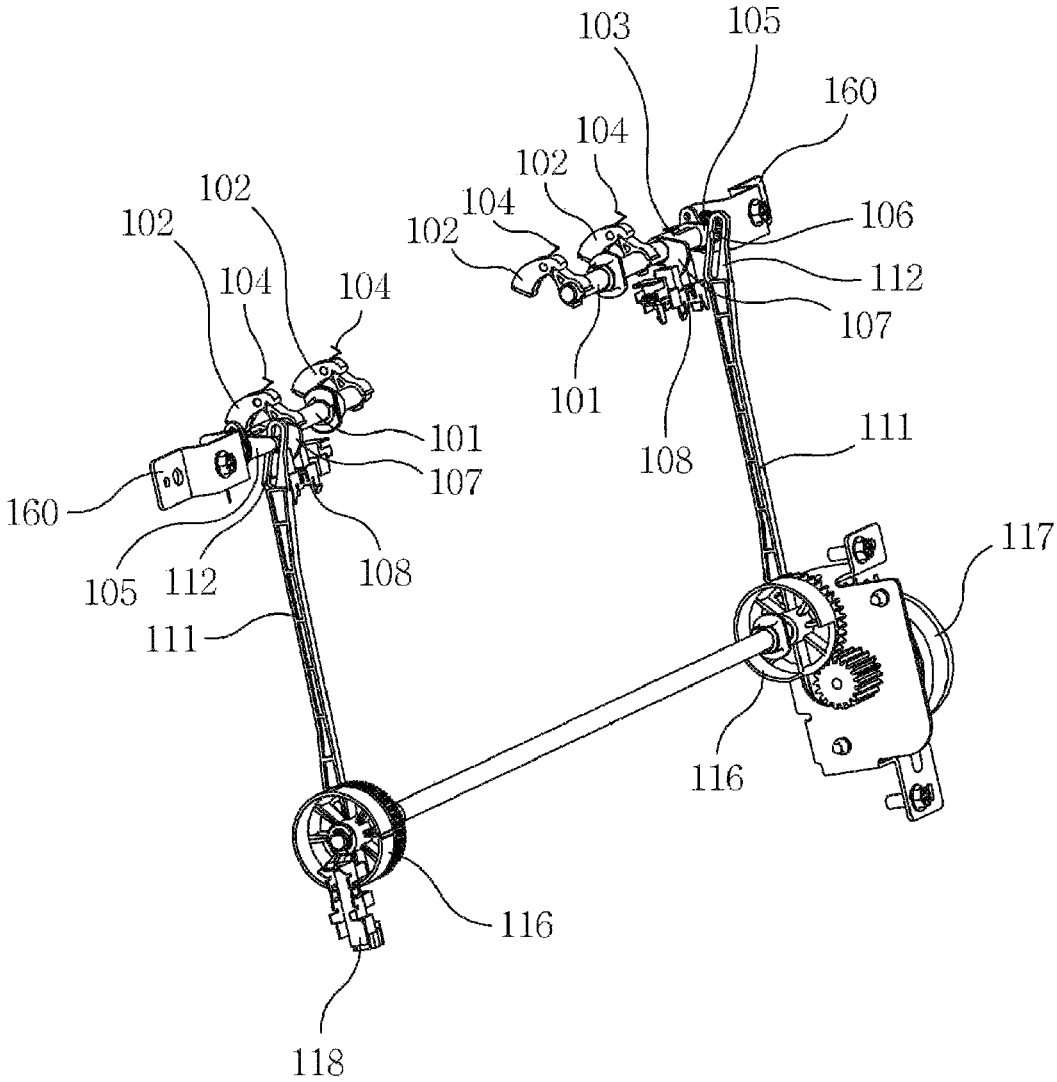
FIG. 7 is a perspective view showing an opposite side of the paper suppressing device according to the present invention.
Figure 8:
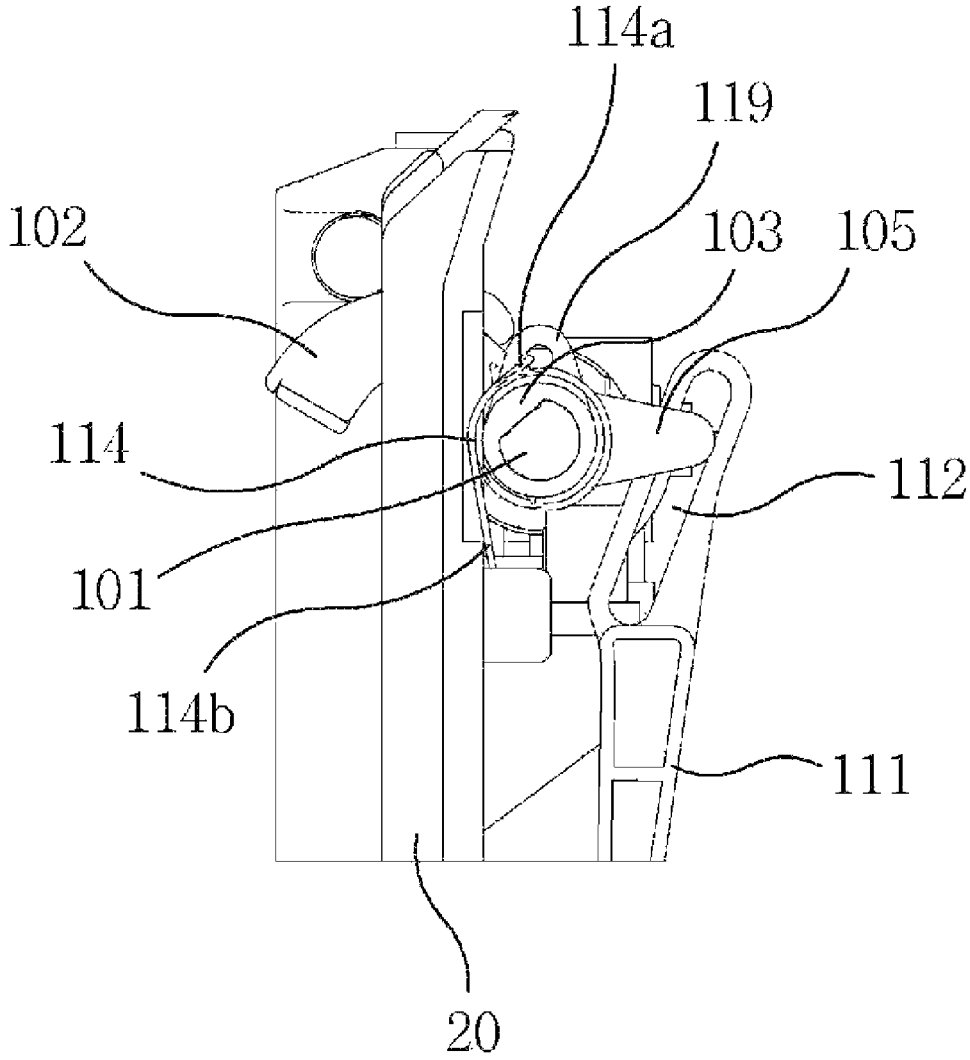
FIG. 8 is a side view showing main components in order to explain the assembling structure of a control mass and a spring according to the present invention.
Figure 9:
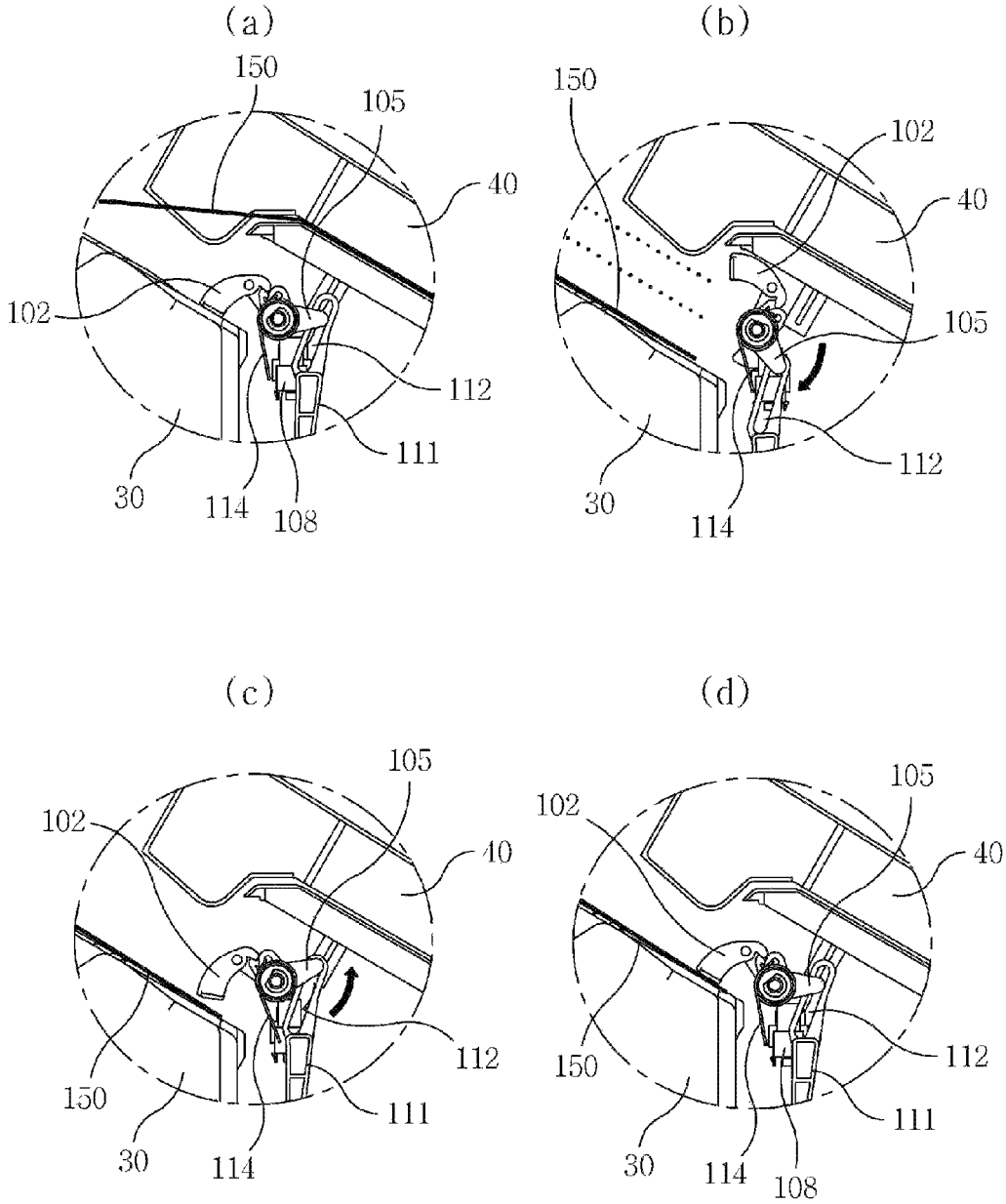
FIGS. 9A to 9D are views showing the operating procedure of the paper suppressing device according to the present invention.

As shown in FIGS. 6 and 8, the paper suppressing device 10 includes a clamp holder shaft 101 and clamps 102 which are elastically supported on the claim holder shaft 101 by interposing the springs 104 therebetween. The clamps 102 form a right angle with respect to the clamp holder shaft 101, and the elasticity of the clamps 102 is maintained by the springs 104 to absorb the impact caused by the contact between the clamps 102 and the stack surface of the stacker tray 30.

A control mass 103 is fixed to one side of each clamp holder shaft 101 to control the rotation of the clamp holder shaft 101.

The control mass 103 includes a fixing member 105 protruding in a direction to form a right angle with respect to the clamp holder shaft 101, a pin 106 protruding in a direction to form a right angle with respect to an end portion of the fixing member 105, and a lever 107 protruding while being adjacent to the fixing member 105 in substantially parallel to the fixing member 105.

A lever sensor 108 is installed below the lever 107. The lever sensor 108 may be attached to the paper protective plate 20, or may be fixed to the clamp holder shaft 101 such that the lever sensor 108 is maintained in the right position independently from the rotation of the clamp holder shaft 101.

A spring 114 is fitted around the control mass 103 such that the torque is always applied to the clamp holder shaft 101 counterclockwise. As shown in FIG. 8, in the spring 114 fitted around the control mass 103, one end portion 114*a* of the spring 114 surrounding a body of the control mass 103 is fixed into a spring fixing groove 119 formed in the control mass 103, and the other end portion 114*b* of the spring 114 is fixedly locked with the side surface of the paper protective plate 20.

The clamp holder shaft 101, which is elastically supported by the spring 114 by interposing the control mass 103 therebetween, is rotatably fixed to a fixing frame 160 of the clamp holder shaft 101.

The fixing frame 160 of the clamp holder shaft 101 is fixed to the paper protective plate 120.

One end portion of the crank arm 111 is coupled with the pin 106 of the control mass 103.

In addition, a slit groove 112, which allows the pin 106 to be movable in the state that the pin 106 is inserted into the slit groove 112, is formed at one end portion of the crank arm 111 coupled with the pin 106 of the control mass 103 in such a manner that the slit groove 112 is slightly inclined with respect to a central direction of the crank arm 111.

An opposite end portion of the crank arm 111 is eccentrically fixed with a rotational shaft of a driving wheel 116. The rotation of the driving wheel 116 is controlled by a driving motor 117, and a home position of the driving wheel 116 is controlled by a sensor 118.

Figure 4:
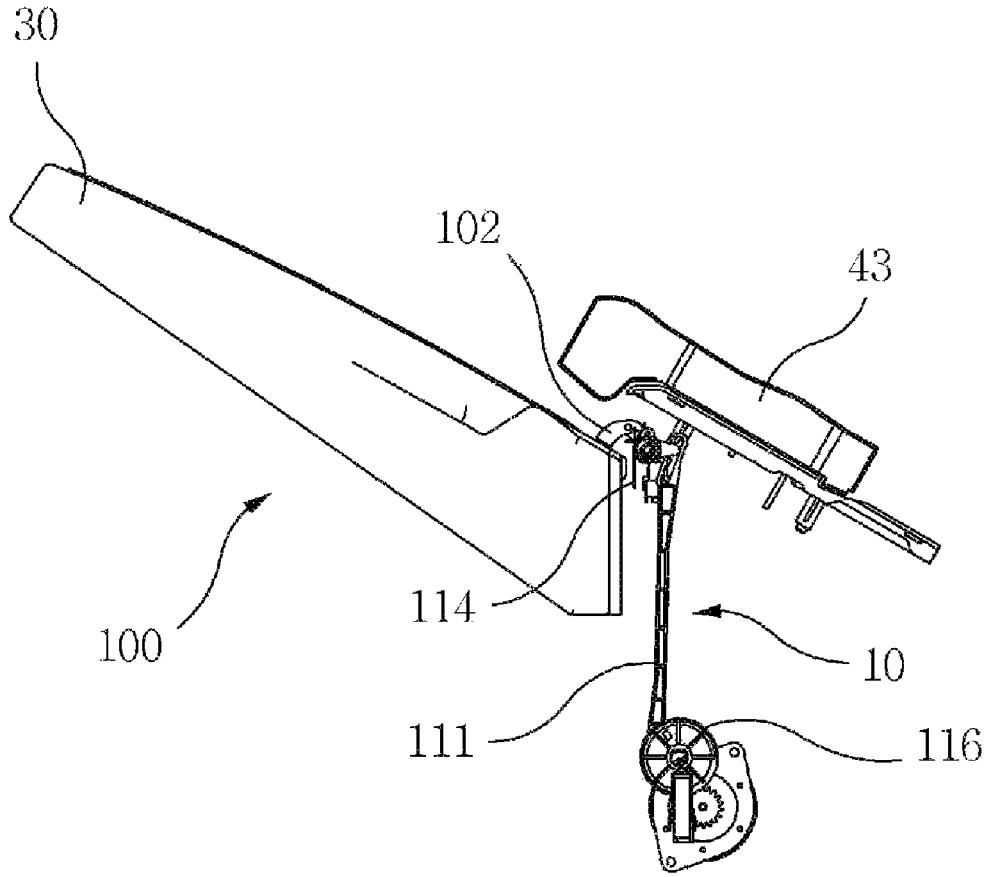
FIG. 4 is a side view showing the paper finishing apparatus without a paper protective plate in order to show a clamp at a home position according to the present invention.

In the paper suppressing device 10 according to the present invention having the above structure, in the state that the pin 106 is movable in the slit groove 112 of the crank arm 111, that is, the position of the pin 106 is not controlled by the crank arm 111, since the clamp holder shaft 101 rotates counterclockwise by the action of the spring 114 as shown in FIG. 4, the clamp 102 rotates toward the paper stack surface of the stacker tray 130, so that the clamp 103 is maintained in a home position state.

Figure 5:
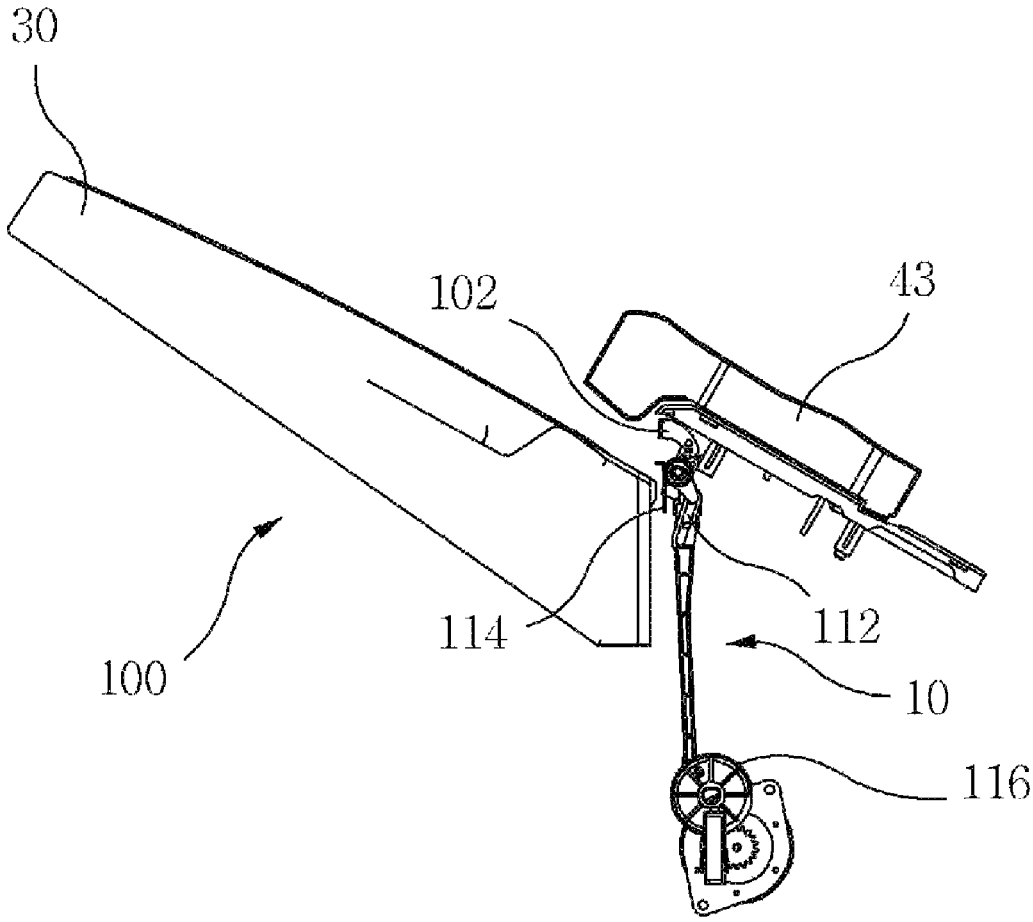
FIG. 5 is a side view showing the paper finishing apparatus without a paper protective plate in order to show a clamp at an open position according to the present invention.

In contrast, if the crank arm 111 is pulled down by rotating the driving motor 117 and the driving wheel 116, the pin 106 of the control mass 103 is locked into an upper end portion of the slit groove 112, so that the clamp holder shaft 101 is forcibly rotated clockwise. Accordingly, the clamp 102 is open in a direction away from the paper stack surface of the stacker tray 30 as shown in FIG. 5.

Hereinafter, the operating procedure of the paper suppressing device 10 according to the present invention will be described by mainly referring to FIGS. 9A and 10.

First, as shown in FIG. 9A, while a paper 150 is being discharged through the paper discharge device 40 in an initial step, the stacker tray 30 and the clamp 102 are maintained in a right position. In other words, if the clamp 102 is pushed up in the process of lifting the stacker tray 30, so that the clamp holder shaft 101 is rotated, the lever 107 is detected by the lever sensor 108. At this time, the lifting of the stacker tray 30 is stopped so that the stacker tray 30 is maintained in the right position. In this process, even if the clamp 102 makes contact with the paper stack surface of the stacker tray 30, the contact impact of the clamp 102 can be absorbed by the action of the spring 104.

Subsequently, as shown in FIG. 9B, before the paper 150 is transferred onto the paper stack surface of the stacker tray 30 after the paper 150 has been completely discharged from the paper discharge device 40, the driving motor 117 and the driving wheel 116 are driven to open the clamp 102. At this time, the stacker tray 30 is moved down by a predetermined distance in order to ensure an enough stack space of the paper 150 that is being transferred.

In the structure shown in FIG. 9B, even if the clamp 102 is open, since the lever 107 is detected by the lever sensor 108, the stacker tray 30 is not lifted again after the stacker tray 30 has been moved down by the predetermined distance.

If the driving motor 117 and the driving wheel 116 are driven again after the paper 150 has been stacked on the stacker tray 30, so that the crank arm 111 is moved up, the lever 107 is separated from the lever sensor 108, and the clamp 102 is rotated toward the stacker tray 30 to move toward the home position as shown in FIG. 9C. If the stacker tray 30 having the paper 150, which has been transferred in the initial stage, is lifted again when the clamp 102 has been rotated toward the stacker tray 30 and stood by at the home position, so that the clamp 102 is pushed up from the home position, the lever 107 is detected by the lever sensor 108. Accordingly, the lifting of the stacker tray 30 is stopped as shown in FIG. 9D.

Thus, discharged papers can be safely stacked on the stacker tray 30 by repeating the operating procedure of FIGS. 9A to 9D.

Figure 10:
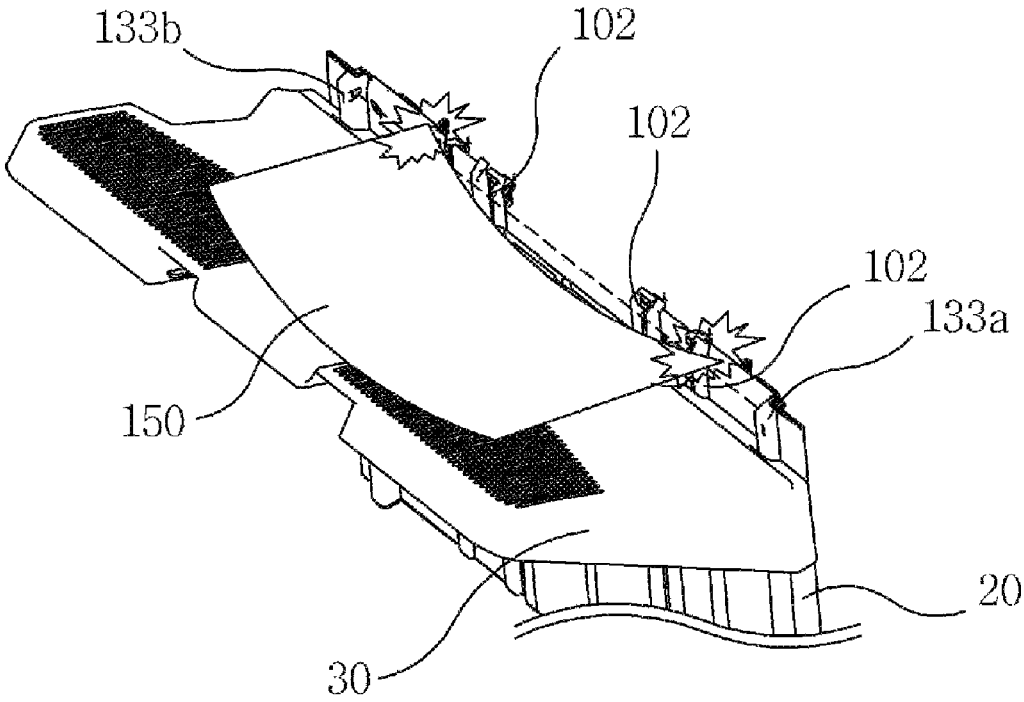
FIG. 10 is a view showing the procedure of overcoming paper stack failure in the paper finishing apparatus equipped with the paper suppressing device according to the present invention.

In order to prepare a case that the end portion of the transferred paper 150 is warped in the shape of an arc, so that the clamp 102 cannot press the paper 150 as shown in FIG. 10, paper stack height sensors 133*a* and 133*b* are additionally installed at both ends of the stacker tray 30, so that the stacker tray 30 may be moved down by the height corresponding to the detected paper height.

For example, the sensor 133*a* may include a light receiving sensor, and the sensor 133*b* may include a light emitting sensor.

Therefore, it will be understood to those skilled in the art that various modifications, additions and substitutions are possible, without departing from the scope and spirit of the invention as disclosed in the accompanying claims.

What is claimed is:

1. A paper suppressing device for a paper finishing apparatus including a stacker tray provided at one side of a paper protective plate to move up and down, a paper discharge device provided at an opposite side of the paper protective plate to align a paper and transfer the paper onto the stacker tray and the paper suppressing device interposed between the stacker tray and the paper discharge device, wherein the paper suppressing device comprises a clamp unit that is open while the paper is being transferred onto the stacker tray, and returns to an initial position after the paper has been transferred onto the stacker tray to suppress papers stacked onto the stacker tray, wherein the clamp unit includes a clamp holder shaft, a clamp installed on the clamp holder shaft, a crank arm rotating the clamp holder shaft by a predetermined angle to open the clamp fixed onto the clamp holder shaft, and a driving wheel driving the crank arm, a control mass fixed onto the clamp holder shaft and including a fixing member protruding from the clamp holder shaft perpendicularly to the clamp holder shaft, a pin provided perpendicularly to an end portion of the fixing member, and a lever protruding adjacent to the fixing member, wherein the crank arm has one end portion with a slit groove engaged with the pin of the control mass in such a manner that the pin is movable, and an opposite end portion eccentrically coupled with a rotational shaft of the driving wheel.

2. The paper suppressing device of claim 1, wherein the clamp is elastically supported on the clamp holder shaft by interposing a first spring therebetween, and the clamp holder shaft is elastically supported by a second spring.

3. The paper suppressing device of claim 1, further comprising a paper stack height sensor installed on at least one side of the stacker tray.

4. The paper suppressing device of claim 1, wherein the crank arm includes a pair of crank arms and the clamp includes two pairs of clamps.

5. The paper suppressing device of claim 1, wherein the clamp holder shaft is rotated in such a manner that the clamp moves toward the stacker tray when the pin of the control mass is movable in the slit groove of the crank arm, and the clamp holder shaft is rotated in such a manner that the clamp moves away from the stacker tray when the pin of the control mass inserted into the slit groove is pulled by the crank arm.

6. The paper suppressing device of claim 5, further comprising a lever sensor installed at a lower portion of the control mass, wherein, if the lever is detected by the lever sensor due to rotation of the clamp holder shaft as the stacker tray, which is being lifted up along the paper protective plate, makes contact with the clamp, the lifting of the stacker tray is stopped.

* * * * *